US009855185B2

(12) United States Patent
Chen

(10) Patent No.: US 9,855,185 B2
(45) Date of Patent: Jan. 2, 2018

(54) ADJUSTABLE MASSAGING DEVICE

(71) Applicant: Paul Chen, Vancouver (CA)

(72) Inventor: Paul Chen, Vancouver (CA)

( * ) Notice: Subject to any disclaimer, the term of this patent is extended or adjusted under 35 U.S.C. 154(b) by 489 days.

(21) Appl. No.: 14/694,003

(22) Filed: Apr. 23, 2015

(65) Prior Publication Data

US 2016/0310349 A1 Oct. 27, 2016

(51) Int. Cl.
*A61H 15/00* (2006.01)

(52) U.S. Cl.
CPC ..... *A61H 15/00* (2013.01); *A61H 2015/0014* (2013.01); *A61H 2201/0192* (2013.01); *A61H 2201/1695* (2013.01)

(58) Field of Classification Search
CPC ..... A61H 15/00; A61H 2201/1695; A61H 2201/0192; A61H 2015/0014
USPC ..... D21/478, 479; D24/200, 211, 212, 213, D24/214, 215
See application file for complete search history.

(56) References Cited

U.S. PATENT DOCUMENTS 1,577,924 A * 3/1926 Matchett ..... A61H 23/0254 601/103
4,807,603 A 2/1989 Yasui
5,389,063 A * 2/1995 Wu ..... A61H 7/001 273/153 S
8,888,808 B1 11/2014 Park

* cited by examiner

*Primary Examiner* — Justine Yu
*Assistant Examiner* — Timothy Stanis
(74) *Attorney, Agent, or Firm* — Charles E. Baxley

(57) ABSTRACT

A massaging device includes a housing having a chamber and a number of grooves communicating with the chamber of the housing, the housing has a number of massaging protrusions, a casing is engaged in the housing and includes a number of massaging projections slidably engaged with the grooves of the housing, and a cover is secured to the casing for moving the casing relative to the housing and for moving the massaging projections of the casing relative to and along the grooves of the housing respectively. The casing includes a number of beams each having a number of massaging projections. The cover includes a number of catches engaged with the beams for securing the beams of the casing together.

14 Claims, 5 Drawing Sheets

ADJUSTABLE MASSAGING DEVICE

BACKGROUND OF THE INVENTION

1. Field of the Invention

The present invention relates to a massaging device, and more particularly to a massaging device including an adjustable structure or configuration for adjusting the arrangement of the massaging members and for adjusting the massaging effects to the users.

2. Description of the Prior Art

Typical massaging devices comprise a relatively harder or stronger inner housing, and a relatively softer or resilient outer layer for selectively contacting or engaging with the users and for massaging purposes.

For example, U.S. Pat. No. 4,807,603 to Yasui discloses one of the typical massaging devices also comprising a relatively harder or stronger inner housing having a cylindrical shape, and a relatively softer or resilient outer layer for selectively contacting or engaging with the users and for massaging purposes.

However, the outer layer includes a smooth outer peripheral structure or contour that may not be frictionally contacted or engaged with the users such that the users may not be massaged with the typical massaging devices.

U.S. Pat. No. 8,888,808 to Park discloses another typical massaging device comprising a planar base member having a number of projections or protrusions extended outwardly therefrom for frictionally contacting or engaging with the users and for massaging purposes.

However, the projections or protrusions extended outwardly from the planar base member, but may not be adjusted relative to the planar base member, and thus may not provide different massaging forces or effects to the users.

The present invention has arisen to mitigate and/or obviate the afore-described disadvantages of the conventional massaging devices.

SUMMARY OF THE INVENTION

The primary objective of the present invention is to provide a massaging device including an adjustable structure or configuration for adjusting the arrangement of the massaging members and for adjusting the massaging effects to the users.

In accordance with one aspect of the invention, there is provided a massaging device comprising a housing including a chamber formed therein, and including a number of grooves formed in the housing and communicating with the chamber of the housing, the housing including a number of massaging protrusions extended therefrom, a casing received and engaged in the chamber of the housing and movable relative to the housing, and the casing including a number of massaging projections extended therefrom and slidably engaged with the grooves of the housing respectively, and a first cover secured to the casing for moving the casing relative to the housing, and for moving the massaging projections of the casing relative to and along the grooves of the housing respectively to adjust the relative position between the massaging projections of the casing and the massaging protrusions of the housing and for providing different massaging effect to the user.

The grooves of the housing are selected from axial grooves arranged parallel to a longitudinal axis (X) of the housing. The casing includes a number of beams each having a number of massaging projections extended therefrom. The housing includes a second cover secured to the beams of the casing for moving the casing relative to the housing.

The second cover includes a number of catches extended therefrom and engaged with the beams respectively for securing the beams of the casing together. The first cover also includes a number of catches extended therefrom and engaged with the beams respectively for securing the beams of the casing together and for moving the casing relative to the housing.

The housing includes a first orifice and a second orifice formed therein, the first cover includes a knob slidably attached to the first cover, and includes a key extended from the knob for engaging with either of the first or the second orifice of the housing and for positioning the first cover and the casing to the housing at selected positions.

The first cover includes a spring biasing member engaged between the first cover and the knob for biasing the key of the knob to engage with either of the first or the second orifice of the housing.

The first cover includes a compartment formed therein for engaging with the knob. The first cover includes an aperture formed therein and communicating with the compartment of the first cover for engaging with the key of the knob. The knob includes a hole formed therein for engaging with the finger of the user and for allowing the user to rotate the cover relative to the housing.

The housing includes a number of slots formed in the housing and communicating with the chamber of the housing and communicating with the grooves of the housing respectively for slidably engaging with the massaging projections of the casing respectively.

The slots of the housing are selected from lateral slots arranged perpendicular to a longitudinal axis X of the housing and perpendicular to the grooves of the housing respectively. The housing includes two orifices formed therein, the first cover includes a knob slidably attached to the first cover, and includes a key extended from the knob for engaging with either of the orifices of the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
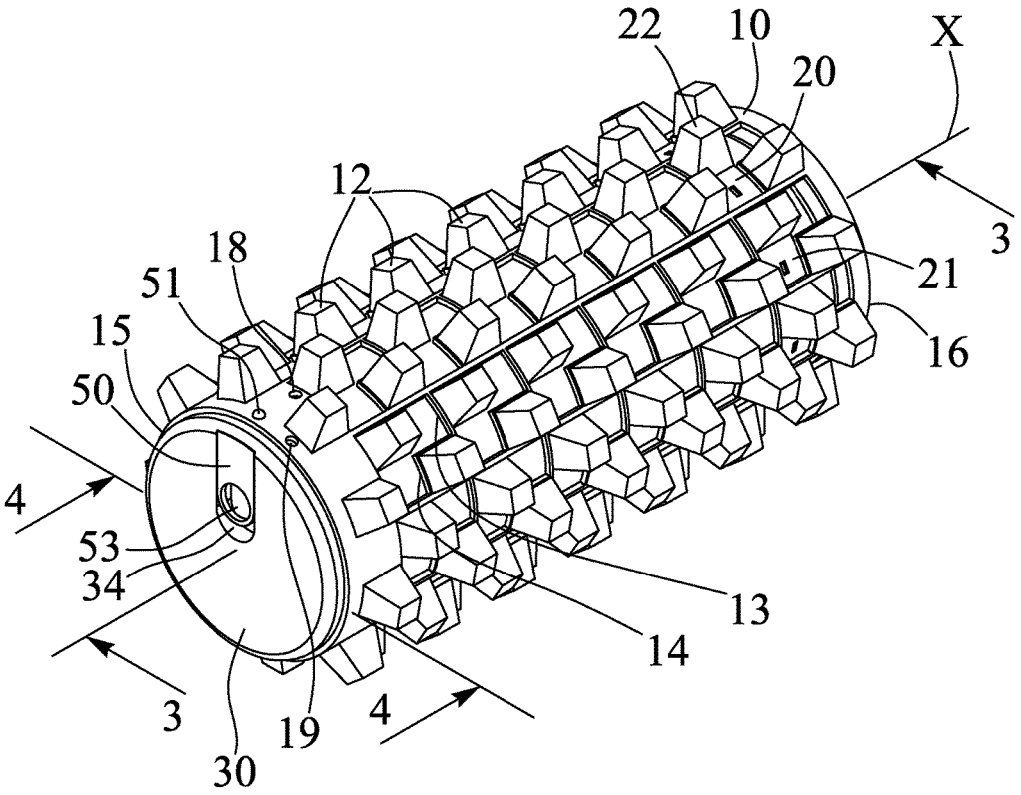
FIG. 1 is a perspective view of a massaging device in accordance with the present invention.

Referring to the drawings, and initially to FIGS. 1-5, a massaging device in accordance with the present invention comprises an outer receptacle or housing 10 made of a relatively harder or stronger materials, such as plastic, synthetic materials or the like, the housing 10 preferably includes a cylindrical shape or contour having a bore or inner compartment or chamber 11 formed therein, and includes a number of massaging protrusions 12 extended radially and outwardly therefrom and made of a relatively softer or resilient material, such as plastic, synthetic materials, rubber or the like for softly and comfortably contacting or engaging with the users and for massaging purposes.

Figure 5:
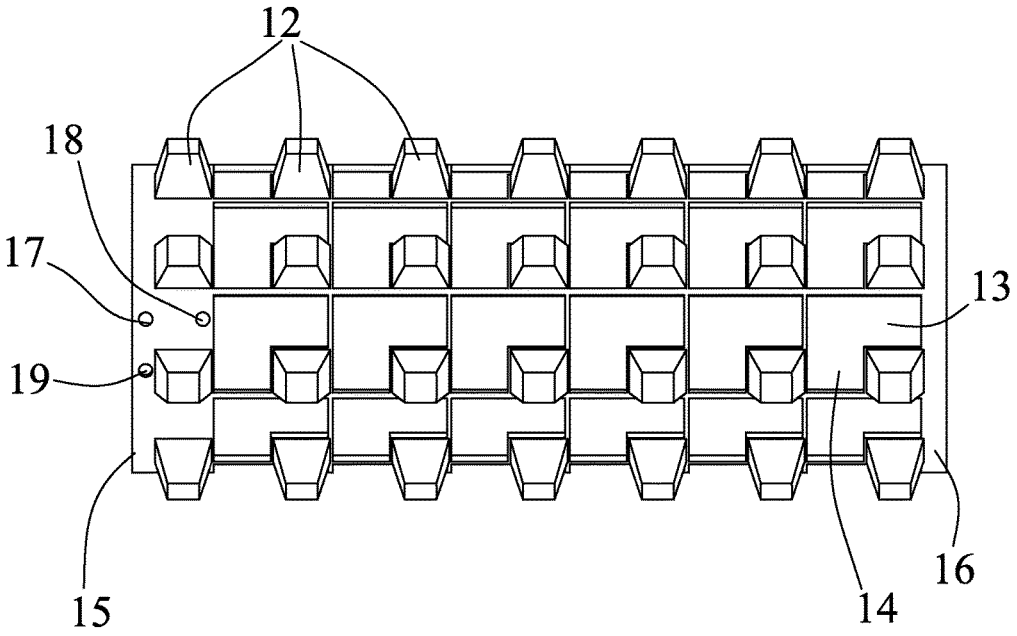
FIG. 5 is a top plan schematic view illustrating an outer housing of the massaging device.

The housing 10 further includes a number of axial grooves 13 and a number of lateral slots 14 formed therein and communicating with the chamber 11 of the housing 10, and the axial grooves 13 and the lateral slots 14 of the housing 10 are communicating with each other and perpendicular to each other, best shown in FIG. 5, in which the axial grooves 13 of the housing 10 are arranged parallel to the longitudinal axis X (FIG. 1) of the housing 10, and the lateral slots 14 of the housing 10 are arranged laterally and perpendicular to the longitudinal axis X of the housing 10 and also perpendicular to the axial grooves 13 of the housing 10 respectively. The housing 10 further includes two end portions 15, 16, and includes one or more (such as three) orifices 17, 18, 19 formed therein.

For example, as shown in FIGS. 1-2 and 5-7, the orifices 17, 18, 19 are formed in the one or first end portion 15 of the housing 10, in which the first and the second orifices 17, 18 are aligned with the axial grooves 13 of the housing 10, and the third orifice 19 is located beside the first orifice 17 and aligned with the lateral slots 14 of the housing 10, and the first orifice 17 is located farther away from the axial grooves 13 of the housing 10 then the second orifice 18 of the housing 10; i.e., the second orifice 18 of the housing 10 is located closer to the axial grooves 13 of the housing 10 then the first orifice 17 of the housing 10.

An inner receptacle or casing 20 includes one or more (such as nine) bars or beams 21 (FIG. 2) received or engaged in the chamber 11 of the housing 10 and movable axially and laterally relative to the housing 10, the beams 21 of the casing 20 may be separated or spaced from each other; or may be solidly and stably secured together, or formed integral with each other, the casing 20 and/or the beams 21 each include a number of massaging projections 22 extended radially and outwardly therefrom and movably or slidably engaged with the axial grooves 13 and the lateral slots 14 of the housing 10 respectively, and movable or slidable along either of the axial grooves 13 or the lateral slots 14 of the housing 10.

Figure 6:
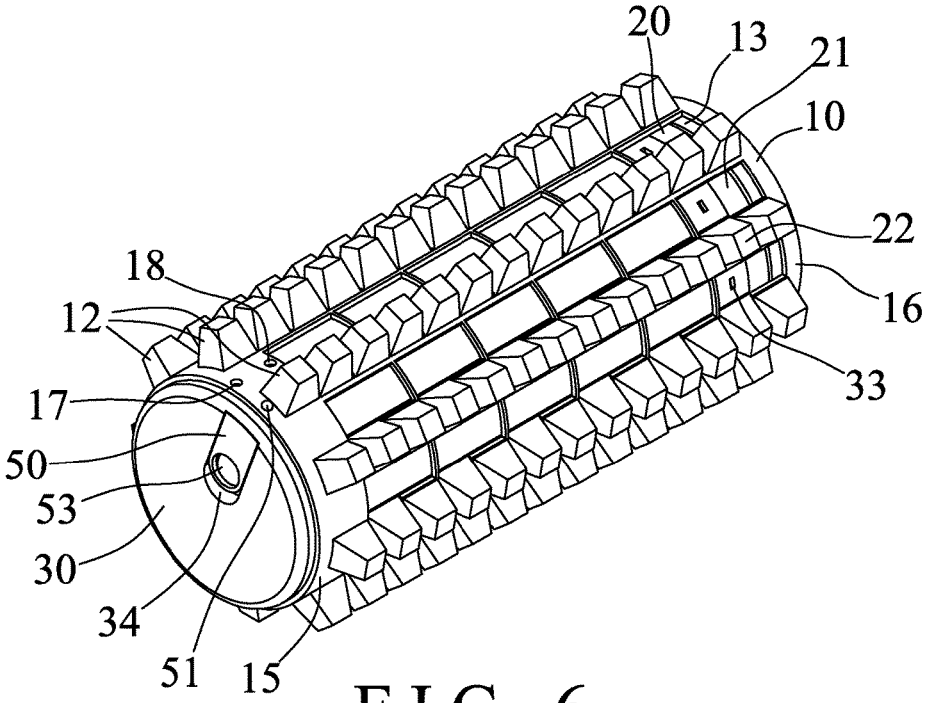
FIGS. 6, 7 are perspective views similar to FIG. 1, illustrating the operation of the massaging device.
Figure 7:
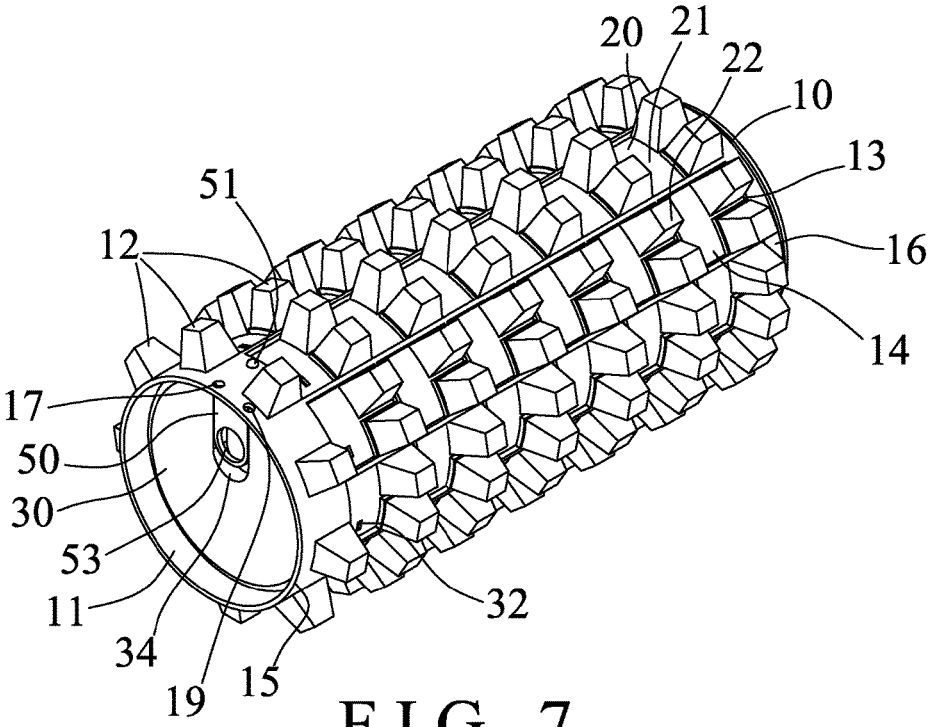

For example, as shown in FIG. 6, the massaging projections 22 of the beams 21 or of the casing 20 may be moved or engaged into the lateral slots 14 of the housing 10 respectively and engaged or located between the massaging protrusions 12 of the housing 10 for forming or defining several or nine rows or lines of massaging members 12, 22 and for massaging purposes. As shown in FIG. 7, the massaging projections 22 of the beams 21 or of the casing 20 may also be moved or engaged into the axial grooves 13 of the housing 10 respectively and engaged or located between the massaging protrusions 12 of the housing 10 for forming or defining several rounds or circles of massaging members 12, 22 and for massaging purposes.

As shown in FIG. 1, the massaging projections 22 of the beams 21 or of the casing 20 may also be engaged or located at the adjacent portions of the axial grooves 13 and the lateral slots 14 of the housing 10, and offset or separated or spaced from the massaging protrusions 12 of the housing 10 for allowing the massaging projections 22 of the beams 21 or of the casing 20 and the massaging protrusions 12 of the housing 10 to be arranged in a stagger way relative to each other, and for providing a massaging effect different from that shown in FIGS. 5 and 6. The beams 21 of the casing 20 are made of a relatively harder or stronger material, such as plastic, synthetic materials or the like, and the massaging projections 22 of the beams 21 or of the casing 20 are made of a relatively softer or resilient material, such as plastic, synthetic materials, rubber or the like for softly and comfortably contacting or engaging with the users and for massaging purposes. A softer or resilient or foamable layer 23 may further be provided and attached onto the outer peripheral portion of the massaging protrusions 12 of the housing 10 and/or the massaging projections 22 of the beams 21 or of the casing 20 for softly and comfortably contacting or engaging with the users.

Two covers 30, 31 are received or engaged in the end portions 15, 16, and rotatable and slidable relative to the housing 10, the covers 30, 31 each include one or more (such as nine) extensions or catches 32, 33 extended axially therefrom and engaged with the beams 21 respectively (FIG. 3) for connecting or coupling or securing the beams 21 of the casing 20 together, and thus for allowing the massaging projections 22 of the beams 21 or of the casing 20 to be moved relative to the housing 10 with either of the covers 30, 31. One of the covers 30 includes a recess or compartment 34 formed therein, and includes an aperture 35 formed therein and communicating with the compartment 34 of the cover 30.

Figure 2:
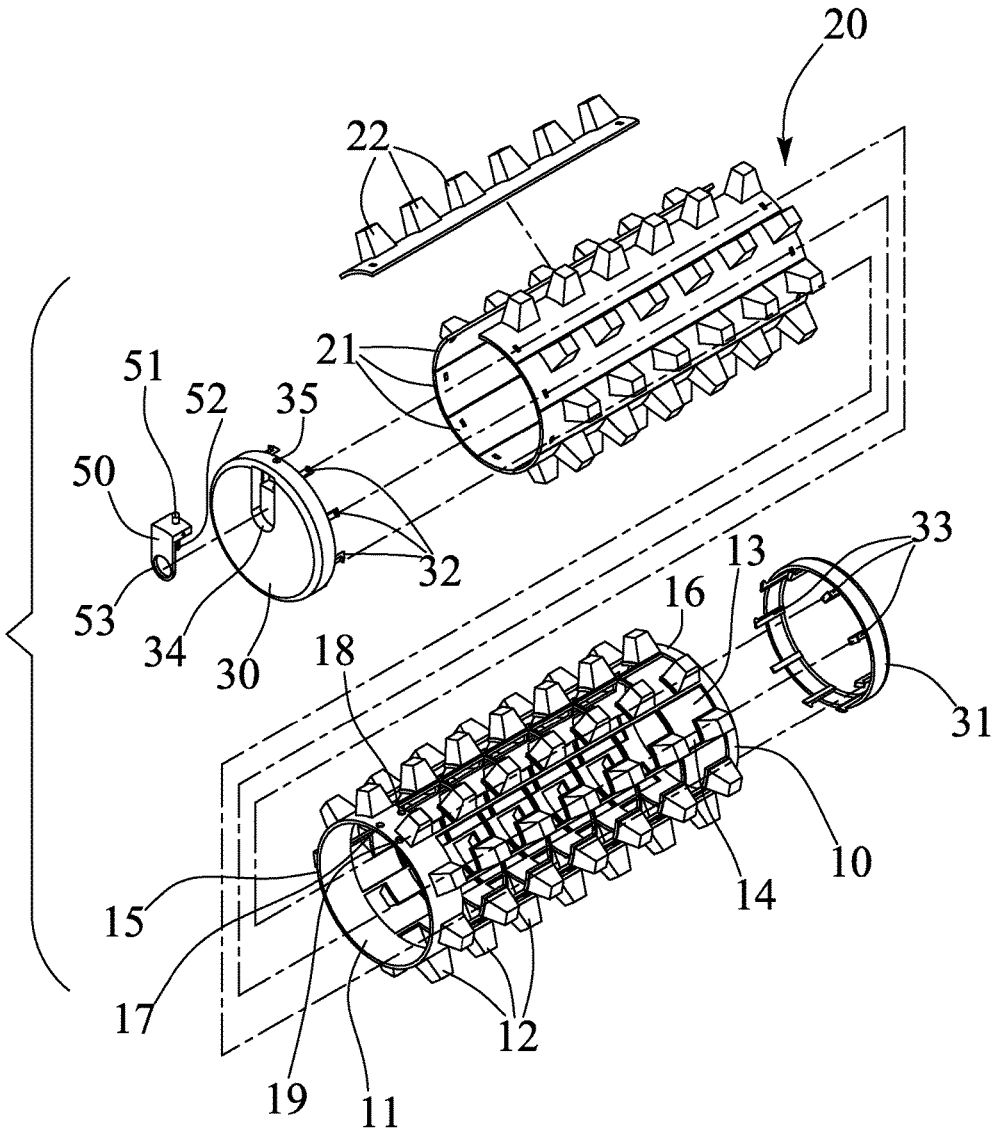
FIG. 2 is an exploded view of the massaging device.
Figure 3:
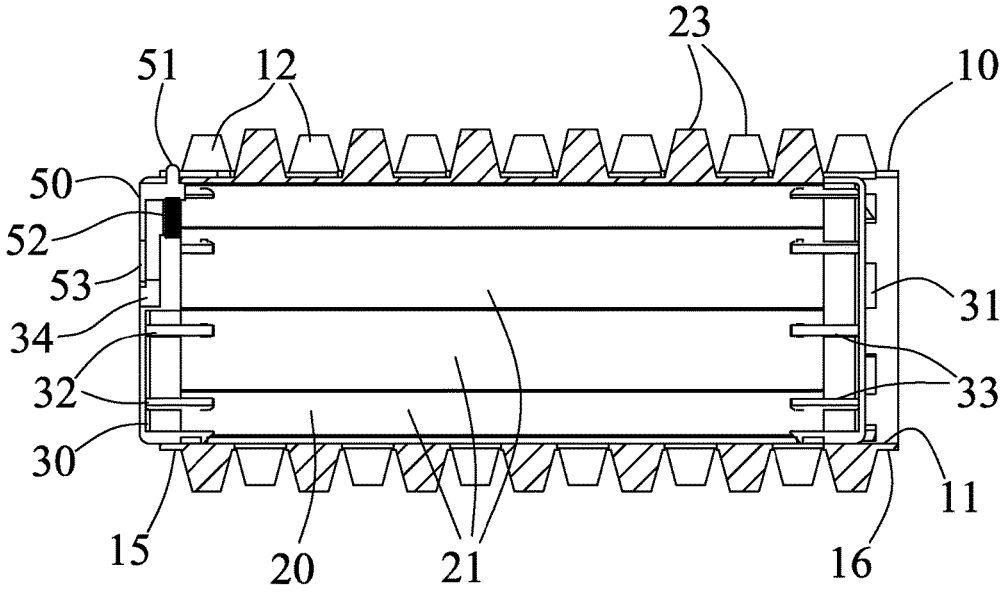
FIG. 3 is a cross sectional view of the massaging device, taken along lines 3-3 of FIG. 1.
Figure 4:
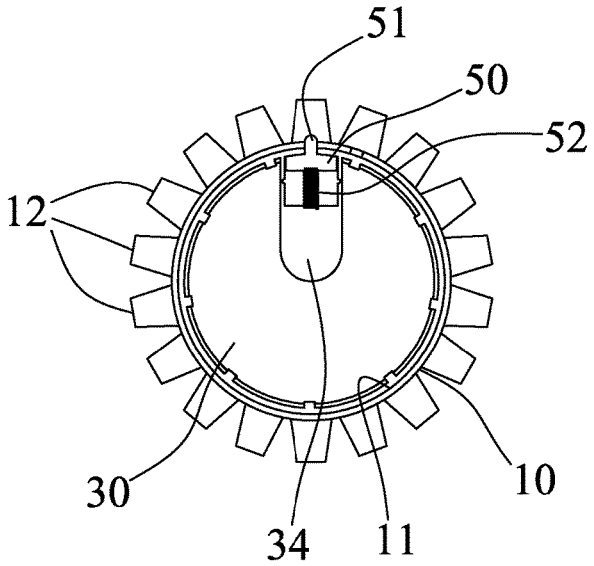
FIG. 4 is another cross sectional view of the massaging device, taken along lines 4-4 of FIG. 1.

A follower or knob 50 is movably or slidably received or engaged in the compartment 34 of the cover 30, and includes a tongue or key 51 extended therefrom, best shown in FIGS. 2-4, for selectively extending into or engaging with either of the orifices 17, 18, 19 of the housing 10 (FIGS. 1, 6-7), a spring biasing member 52 is disposed or engaged between the cover 30 and the knob 50 for biasing and forcing or moving the key 51 of the knob 50 to engage with either of the orifices 17, 18, 19 of the housing 10. It is preferable, but not necessary that the knob 50 includes a hole 53 formed therein for engaging with the finger of the user (not illustrated) and for allowing the knob 50 and the cover 30 to be easily moved or rotated relative to the housing 10 by the user.

In operation, as shown in FIG. 1, the massaging projections 22 of the beams 21 or of the casing 20 may be engaged or located at the adjacent portions of the axial grooves 13 and the lateral slots 14 of the housing 10, and offset or separated or spaced from the massaging protrusions 12 of the housing 10 for allowing the massaging projections 22 of the beams 21 or of the casing 20 and the massaging protrusions 12 of the housing 10 to be arranged in a stagger way relative to each other, and for providing a massaging effect to the user. At this moment, the key 51 of the knob 50 is engaged with one of the orifices 17 of the housing 10 to anchor and position the casing 20 to the housing 10.

As shown in FIG. 6, the massaging projections 22 of the beams 21 or of the casing 20 may be moved or engaged into the lateral slots 14 of the housing 10 respectively and engaged or located between the massaging protrusions 12 of the housing 10 for forming or defining several or nine rows or lines of massaging members 12, 22 and for massaging purposes. As shown in FIG. 7, the massaging projections 22 of the beams 21 or of the casing 20 may also be moved or engaged into the axial grooves 13 of the housing 10 respectively and engaged or located between the massaging protrusions 12 of the housing 10 for forming or defining several rounds or circles of massaging members 12, 22 and for massaging purposes.

Accordingly, the massaging device in accordance with the present invention includes an adjustable structure or configuration for adjusting the arrangement of the massaging members and for adjusting the massaging effects to the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A massaging device comprising:

a housing including a chamber formed therein, and including a plurality of grooves formed in said housing and communicating with said chamber of said housing, said housing including a plurality of massaging protrusions extended therefrom, a casing received and engaged in said chamber of said housing and movable relative to said housing, and said casing including a plurality of massaging projections extended therefrom and slidably engaged with said grooves of said housing respectively, and a first cover secured to said casing for moving said casing relative to said housing, and for moving said massaging projections of said casing relative to and along said grooves of said housing respectively.

2. The massaging device as claimed in claim 1, wherein said grooves of said housing are selected from axial grooves arranged parallel to a longitudinal axis (X) of said housing.

3. The massaging device as claimed in claim 1, wherein said casing includes a plurality of beams each having a plurality of massaging projections extended therefrom.

4. The massaging device as claimed in claim 3, wherein said housing includes a second cover secured to said beams of said casing.

5. The massaging device as claimed in claim 4, wherein said second cover includes a plurality of catches extended therefrom and engaged with said beams respectively for securing said beams of said casing together.

6. The massaging device as claimed in claim 3, wherein said first cover includes a plurality of catches extended therefrom and engaged with said beams respectively for securing said beams of said casing together.

7. The massaging device as claimed in claim 1, wherein said housing includes a first orifice and a second orifice formed therein, said first cover includes a knob slidably attached to said first cover, and includes a key extended from said knob for engaging with either of said first or said second orifice of said housing.

8. The massaging device as claimed in claim 7, wherein said first cover includes a spring biasing member engaged between said first cover and said knob for biasing said key of said knob to engage with either of said first or said second orifice of said housing.

9. The massaging device as claimed in claim 7, wherein said first cover includes a compartment formed therein for engaging with said knob.

10. The massaging device as claimed in claim 9, wherein said first cover includes an aperture formed therein and communicating with said compartment of said first cover for engaging with said key of said knob.

11. The massaging device as claimed in claim 7, wherein said knob includes a hole formed therein.

12. The massaging device as claimed in claim 1, wherein said housing includes a plurality of slots formed in said housing and communicating with said chamber of said housing and communicating with said grooves of said housing respectively for slidably engaging with said massaging projections of said casing respectively.

13. The massaging device as claimed in claim 12, wherein said slots of said housing are selected from lateral slots arranged perpendicular to a longitudinal axis (X) of said housing and perpendicular to said grooves of said housing respectively.

14. The massaging device as claimed in claim 13, wherein said housing includes two orifices formed therein, said first cover includes a knob slidably attached to said first cover, and includes a key extended from said knob for engaging with either of said orifices of said housing.

* * * * *